US005357836A

United States Patent [19]

Strömberg et al.

[11] Patent Number: 5,357,836

[45] Date of Patent: Oct. 25, 1994

[54] DEVICE FOR RETAINING KNIFE BLADES

[76] Inventors: S. A. Roland Strömberg, Granstigen 15, S-694 00 Hallsberg; Rolf A. Larsson, Södra Promenaden 7, S-690 70 Pålsboda, both of Sweden

[21] Appl. No.: 1,777

[22] Filed: Jan. 8, 1993

[30] Foreign Application Priority Data

Jan. 14, 1992 [SE] Sweden ..... 9200101-5

[51] Int. Cl.[5] ..... B26D 1/62

[52] U.S. Cl. ..... 83/698.31; 83/343; 83/698.61

[58] Field of Search ..... 83/698, 699, 700, 343, 83/344, 345, 346, 347, 348

[56] References Cited

U.S. PATENT DOCUMENTS

| | | | |
|---|---|---|---|
| 3,251,256 | 5/1966 | McGrath | 83/674.347 |
| 3,527,123 | 9/1970 | Dovey | 83/698 |
| 3,926,084 | 12/1975 | Blazer | 83/348 |
| 3,935,774 | 2/1976 | Craddy | 83/699 |
| 4,005,627 | 2/1977 | Craddy | 83/674 |
| 4,475,425 | 10/1984 | Punster et al. | 83/700 |
| 4,848,202 | 7/1989 | Crampton | 83/698 |
| 4,920,843 | 5/1990 | Stömberg et al. | 83/346 |

FOREIGN PATENT DOCUMENTS

0095912A2 12/1983 European Pat. Off. .

*Primary Examiner*—Eugenia Jones
*Assistant Examiner*—Allan M. Schrock
*Attorney, Agent, or Firm*—Foley & Lardner

[57] ABSTRACT

The present invention relates to a device for retaining knife blades for cutting, perforation or other treatment of a running web, preferably a paper web. The web runs between a rotatable knife-retaining cylinder and a counter pressure cylinder, whereby the knife blade may be wedged up by a wedge device by being brought into the slot by the counter pressure cylinder. In order to permit effective wedging up of knife blades in exact positions in the slot, even when the blades have dimensions which differ from knife blades of the certain defined dimension, the wedge device comprises and/or cooperates with at least one spring disposed beside the wedge device in the slot, upon insertion of a knife blade into the slot for wedging up thereof by the counter pressure cylinder. The spring is compressible to a dimension which lies within such an interval that it permits insertion of those knife blades into the slot, the dimensions of which differ from the certain, defined dimension and lie within such a certain, defined range of tolerance including the defined dimension. The spring, when compressed to a dimension within the interval, has such a spring force that knife blades having dimensions within the range of tolerance are retained in the slot.

15 Claims, 4 Drawing Sheets

DEVICE FOR RETAINING KNIFE BLADES

BACKGROUND OF THE INVENTION

1. Field of the Invention

The present invention relates to a device for retaining knife blades for cutting, perforation or other treatment of a running web, preferably a paper web, whereby said web runs between a rotatable knife-retaining cylinder and a counter pressure cylinder knife blade cooperates with a wedge device which is adapted to wedge up said knife blade in a slot in the knife-retaining cylinder. Thus, knife blade can be wedged up by means of the wedge device by being brought into the slot by means of the counter pressure cylinder. The wedge device cooperates with a height-adjustment device which is adapted to permit setting of said wedge device at such height in the slot that said wedge device is able to wedge up a knife blade of a certain defined dimension. The wedge device comprises two rulers having downwardly inclined wedge surfaces relative to the slot. The wedge device preferably comprises at least one spring means which is provided to affect the rulers in vertical direction relative to each other in order to retain said rulers and the knife blade in the slot until they are wedged up therein.

2. Description of the Related Art.

A device of the above type is already known from Swedish Patent specification 8900391-7 or from the corresponding U.S. Pat. No. 4,920,843 and it functions with excellence if the knife blades have the required dimensions.

By setting the wedge device such that its height position in the slot is adapted to the required dimension of the knife blade, efficient wedging-up of said knife blade is obtained as well as an exact predetermined position thereof.

However, it has been noticed that knife blades, for various reasons, in some cases do not have the required dimensions, but the height thereof can vary, for examples, within the tolerance interval ±0.2 mm and/or the thickness within the tolerance interval ±0.1 mm. If the knife blades have dimensions lying at the limits of said tolerance intervals, there is a risk that they are either not properly wedged up or that they are wedged up too high up in the slot. This can result in these knife blades loosening from the slot or damaging the counter pressure cylinder or the material to be treated.

SUMMARY OF THE INVENTION

The object of the present invention is to eliminate this problem by means of a simple and reliable device. According to the invention, this is arrived at essentially by providing the abovementioned device with the features that it comprises and/or cooperates with at least one spring means provided to occupy the width of the slot together with the wedge device and the knife blade upon insertion of a knife blade into the slot by means of the counter pressure cylinder for wedging up the knife blade. It is compressible to a dimension which lies within such an interval that it permits insertion of those knife blades into the slot. The dimensions of the knife differ from the certain, defined dimension and lie within such a certain, defined range of tolerance including the defined dimension, and that the spring means, when compressed to a dimension within said interval, has such a spring force that knife blades having dimensions within the range of tolerance are retained in the slot.

By providing the device with the features, it is possible to set the wedge device at a height in the slot that is adapted to knife blades of a certain, defined dimension. It is yet still possible to provide, without risk, knife blades having other dimensions, provided said dimensions lie within a certain range of tolerance, for example, a range of tolerance of about ±0.2 mm regarding the height of the knife blades, and a range of tolerance of about ±0.1 mm regarding the thickness of the knife blades.

BRIEF DESCRIPTION OF THE DRAWINGS

The invention will be further described below with reference to the accompanying drawings, wherein.

DETAILED DESCRIPTION OF THE PREFERRED EMBODIMENT

Figure 1:
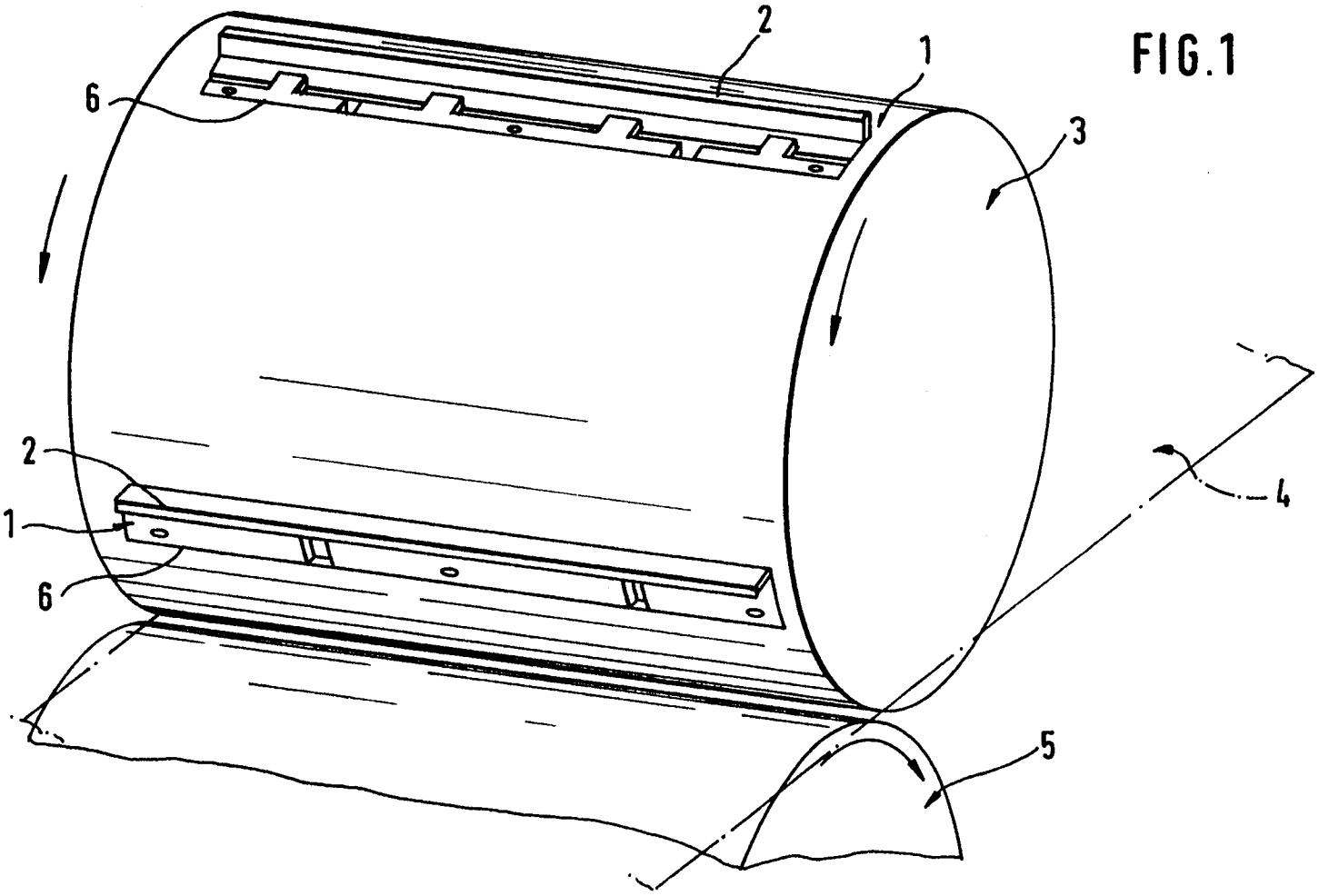
FIG. 1 is a perspective view of two cylinders, of which one cylinder is provided with knife blades retained by a retaining device according to the invention.

The retaining device 1 shown in the drawings is adapted for retaining a knife blade 2 on a rotatable knife-retaining cylinder 3. The knife blade 2 is adapted for cutting, perforating or otherwise treating a running web 4, preferably a paper web, which, for example, runs through a printing press (not shown). The web 4 runs through a space between the knife-retaining cylinder 3 and a rotatable counter pressure cylinder 5 and is shown with dashed and dotted lines in FIG. 1.

The knife-retaining cylinder 3 has a number of slots 6, normally six, wherein knife blades are wedged up by means of a wedge device K. The wedge device K may, for example, comprise a retaining ruler 7 which is adapted to retain the knife blade against one side wall 8*a* of the slot 6. The wedge device K may also comprise a tightening ruler 9, disposed beside the retaining ruler 7 and adapted to engage the opposite side wall 8*b* of the slot 6. The retaining ruler 7 has a wedge surface 10 facing the tightening ruler 9 and extending in a direction sloping downwards relative to the slot 6. In other words, the wedge surface extends such that it, seen from above and downwards, approaches the side wall 8*a* of the slot 6.

The wedge surface 10 of the retaining ruler 7 cooperates with a corresponding wedge surface 11 on the tightening ruler 9. The wedge surface 11 also extends in a downwardly inclined direction relative to the slot 6 and also approaches the side wall 8*a* of said slot seen from above and downwards.

Figure 2:
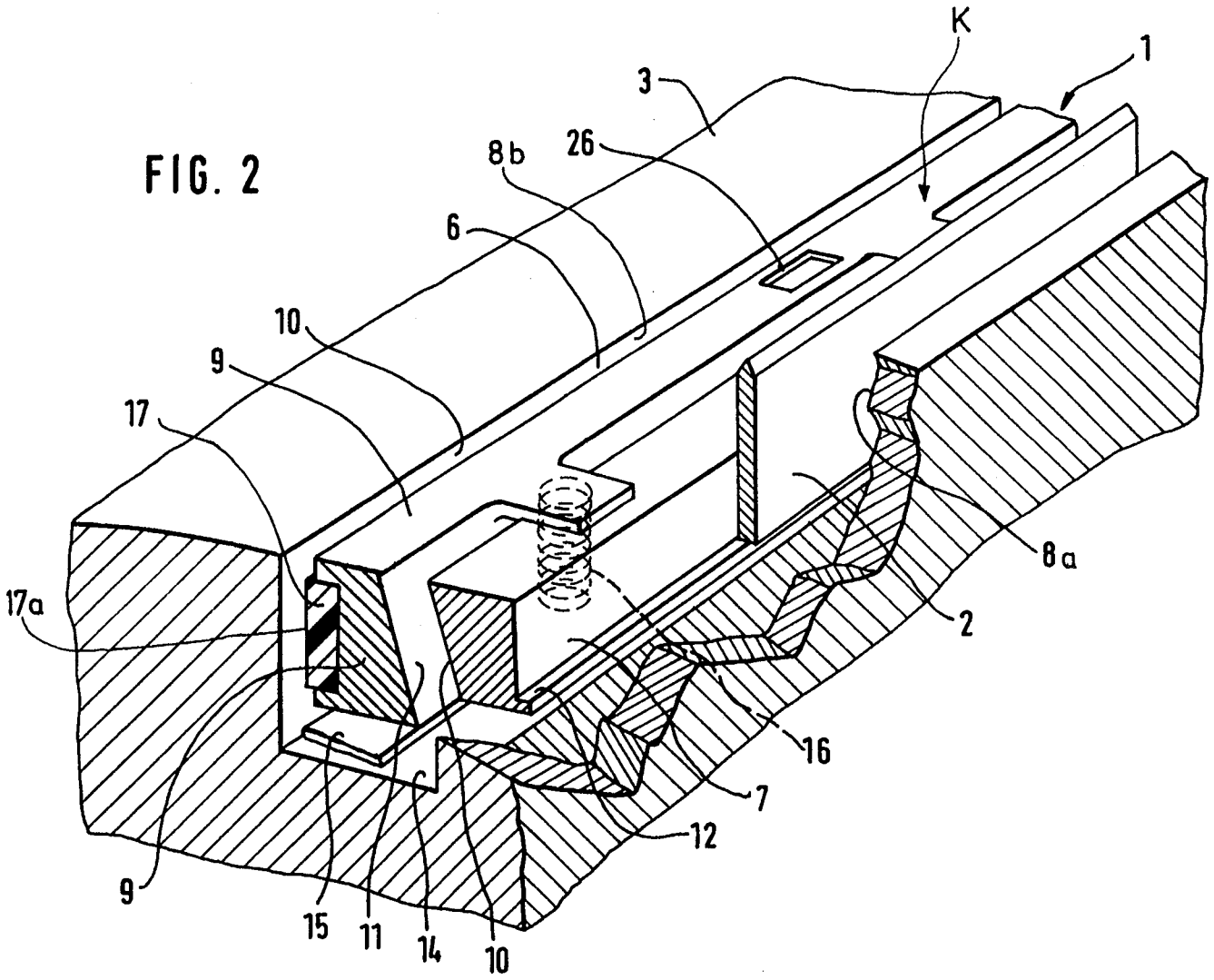
FIG. 2 is a partial sectional view of the retaining device of FIG. 1.
Figure 3:
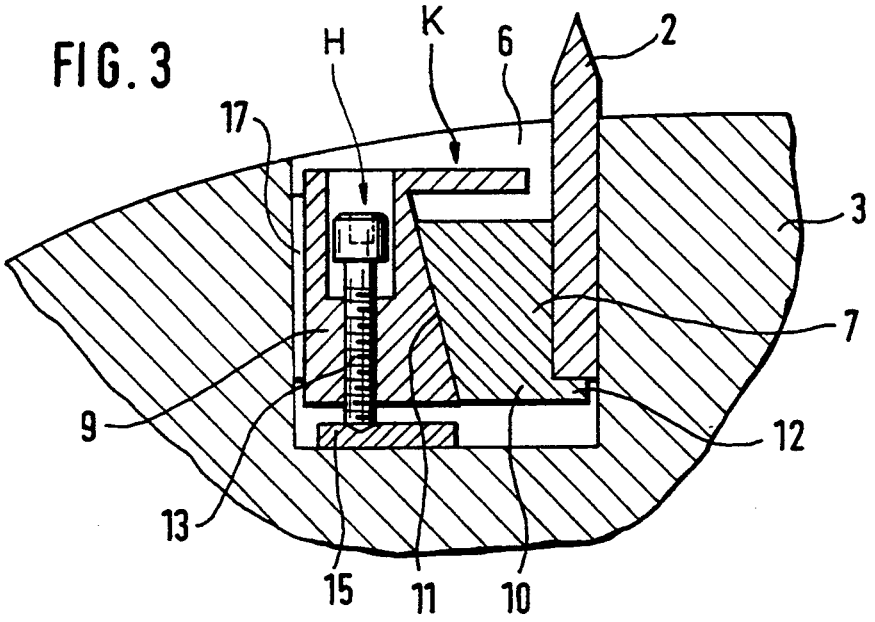
FIG. 3 is a cross-sectional view of the retaining device of FIG. 2 at a location where said device comprises height-adjustment or height-setting means.
Figure 4:
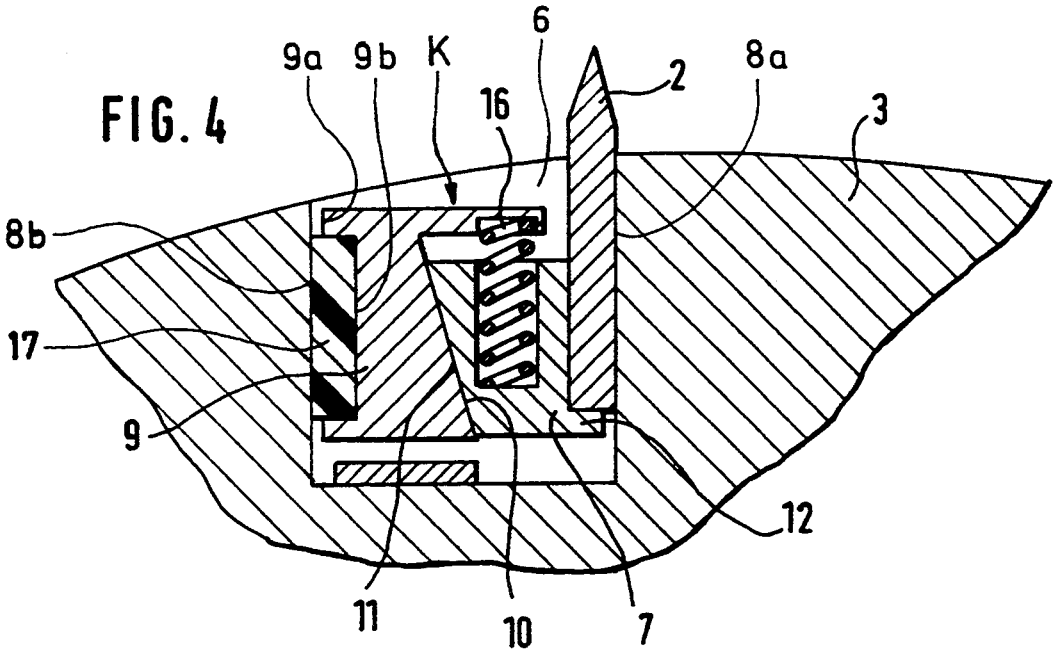
FIG. 4 is a cross-sectional view of the retaining device of FIG. 2 at a location where said device comprises a spring means according to the invention.

The retaining ruler 7 includes a support portion 12 through which the blade 2 displaces the retaining ruler 7 during an adjustment maneuver. This support portion 12 may be provided on different portions of the retaining ruler 7 and may have various designs. A suitable position for the support portion 12 is down below on the retaining ruler 7 as shown in, for example, FIG. 2. The support portion 12 may further preferably be a flange protruding laterally from the retaining ruler 7, extending along the entire length thereof and having a width less than the thickness of the knife blade 2.

The wedge device K cooperates with a height-adjustment or height-setting device H, which is adapted to permit setting of said wedge device K at such a height in the slot 6 that said wedge device is capable of wedging up a knife blade 2 of a certain defined dimension. This height-adjustment device H may include or consist of one or more screws 13 which are screwed into the tightening ruler 9 and protrude downwards as legs through which the tightening ruler 9 engages the bottom 14 of the slot 6, or eventually a protective strip 15 disposed on the bottom 14 of the slot 6 and made of a harder material than the material in the knife-retaining cylinder 3. The heads of the screws 13 are accessible from above so that the screws can be screwed down or up with a tool, whereby the tightening ruler 9 can be lowered or raised in the slot 6.

In order to ensure that the rulers 7, 9 and knife blade 2 remain in the slot 6 until they are wedged up therein resilient means 16 is provided to affect the rulers 7, 9 vertically relative to each other. These resilient means 16 (there are preferably a plurality thereof) are compressible by manually displacing the retaining ruler 7 upwards relative to the tightening ruler 9 until the total width of both rulers 7, 9 and the blade 2 is less than that of the slot 6. The rulers 7, 9 with the blade 2 are in this condition insertable into the slot 6, whereafter they are released. Thereby, the resilient means 16 will displace the retaining ruler 7 relative to the tightening ruler 9, which means that the total width of said rulers 7, 9 and the knife blade is increased until they are fixed in the slot 6. The resilient means may consist of helical compression springs 16, which, down below, engage the retaining ruler 7 and, on top, engage the tightening ruler 9. Said resilient means may alternatively consist of springs of another type.

The knife blade 2 is wedged up by rotating the knife-retaining cylinder 3 in a so-called setting turn relative to the counter pressure cylinder 5. Thereby, the edge of the blade 2 will strike the counter pressure cylinder 5 or a member deposited thereon, with which said blade 2 shall cooperate. Thereby, the peripheral surface of the counter pressure cylinder 5 or the member deposited thereon will press the blade 2 downwards to its cutting position. During this down-stroke pressing, the blade 2 will press the retaining ruler 7 downwards through the support portion 12. This means that the knife blade 2, by means of the rulers 7, 9 of the wedge device K, will automatically wedge up strongly in the slot 6.

In order to efficiently wedge up knife blades 2 in the slot 6, although said blades have dimensions which differ from knife blades of a certain defined dimension after which the height of the wedge device K has been set in the slot 6, said wedge device K comprises and/or cooperates with at least one spring means 17 disposed beside said wedge device in the slot 6 and compressible, upon insertion of a knife blade 2 into the slot 6 for wedging up thereof, to a dimension which lies within such an interval (e.g. 0.5 mm) that it permits insertion of those knife blades 2 into the slot 6, the dimensions of which differ from said certain, defined dimension and lie within such a certain, defined range of tolorance including said defined dimension.

The spring means 17 has, when compressed to a dimension within said interval, such a spring force that knife blades 2 having dimensions within said range of tolerance are retained in the slot 6.

The spring means 17 is preferably mounted in the slot 6 such that it in compressed condition occupies the width of said slot 6 between the side walls 8*a*, 8*b* thereof together with the wedge device K, knife blade 2 and eventually further members disposed beside each other in the slot 6 when said knife blade 2 is wedged up therein.

The spring means 17 preferably consists of such resilient material which is compressible, and which essentially maintains the resilient properties obtained by the compression.

The resilient material of the spring means 17 is preferably polyurethane, and said spring means 17 can have the shape of an elastic strip or similar of polyurethane.

The spring means 17 is preferably arranged such that the tightening ruler 9 engages the side wall 8*b* of the slot 6 through said spring means 17. Furthermore, that side 9*a* of the tightening ruler 9 facing the side wall 8*b* of the slot 6 may be provided with at least one recess 9*b* for the spring means 17, which is of such thickness that it protrudes out of said recess 9*b* and engages said side wall 8*b* of the slot 6.

That portion 17*a* of the spring means 17 situated outside the recess 9*b* has, for example, a width of 0.3–1.0 mm, preferably about 0.5 mm.

Furthermore, the spring means 17 preferably has a height which exceeds half the height of the tightening ruler 9. Additionally, a plurality of spring means 17 are preferably disposed along the tightening ruler 9, preferably on the portions thereof located between the height-adjustment screws 13 provided thereon.

Figure 5:
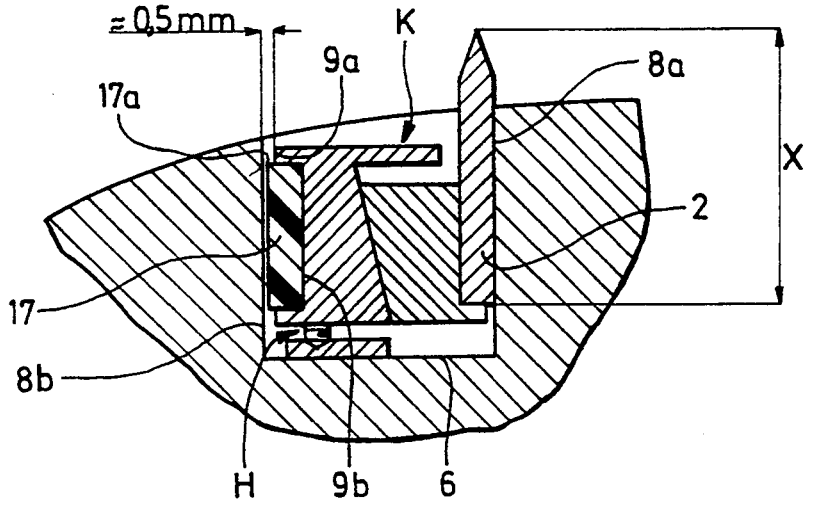
FIG. 5 is a schematic view of the retaining device before wedging up the knife blade.

In FIG. 5, the original shape of the spring means 17, before the knife blade 2 is wedged up in the slot 6, is shown schematically. By means of the height-adjustment device H, the wedge device K is hereby, set at a height in the slot 6 adapted for wedging up knife blades 2 of a certain defined height X. As is shown, the spring means 17 has a width of, for example, a total of 2 mm, whereby the portion 17*a* thereof located outside the recess 9*b* is, for example, 0.5 mm wide.

Figure 6:
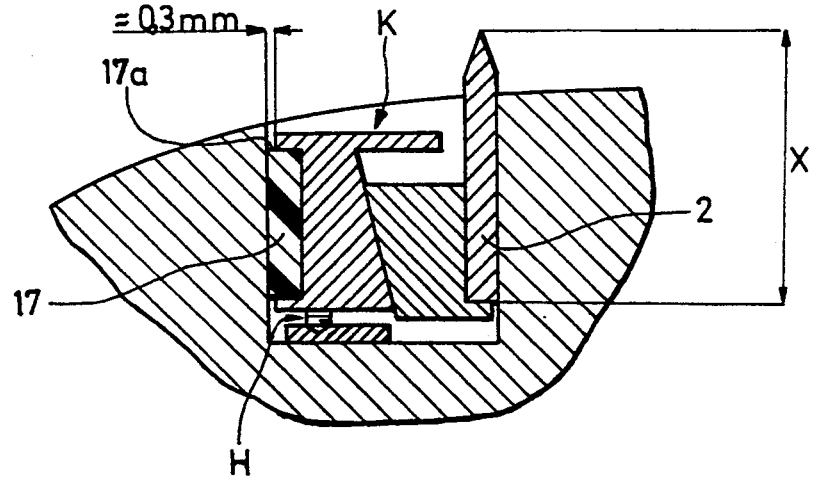
FIG. 6 is a schematic view of the retaining device with wedged up knife blade with a certain, defined height.

In FIG. 6, it is shown how the spring means 17 is compressed when the knife blade 2 with the height X is wedged up. As is shown, the spring means 17 has been compressed such that the portion 17*a* thereof located outside the recess 9*b* is reduced to, for example, 0.3 mm. The spring means 17 hereby exerts a substantially remaining spring force such that the knife blade 2 is retained in the slot 6.

Figure 7:
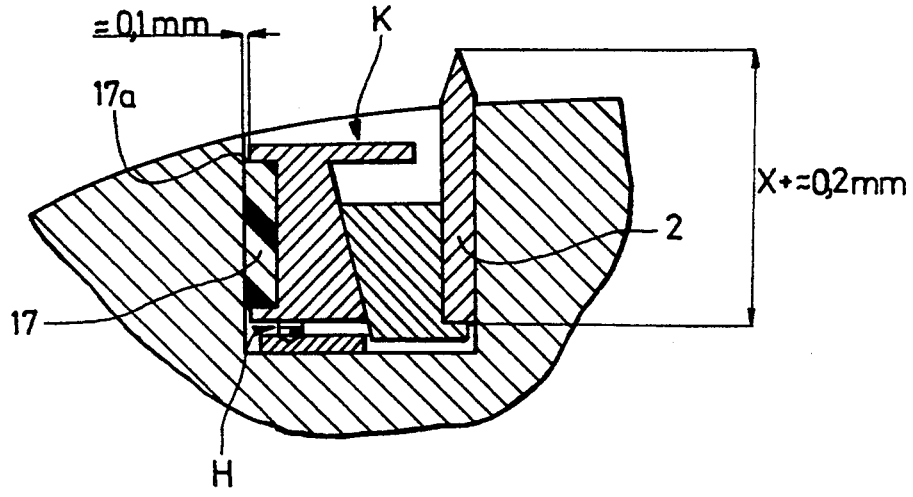
FIG. 7 is a schematic view of the retaining device with the knife blade wedged up with a greater height.

In FIG. 7, it is shown that the spring means 17 has permitted a knife blade 2 with the height X+0.2 to be wedged up in the slot 6 while maintaining the height position of the wedge device K. Here, the spring means 17 has been compressed more than in the embodiment described above, such that the portion 17*a* thereof located outside the recess 9*b* is reduced to, for example, 0.1 mm.

Similarly, the spring means 17 permits mounting of knife blades 2 deviating from a certain, defined dimension regarding their height and/or width, provided that the deviations in dimension lie within a certain, defined interval.

The dimensions of the spring means 17 may vary in such a way that it can be compressible from its original shape to between 0.1–1.0 mm and/or such that it permits application and retention of knife blades 2, the height of which varies within an interval of up to, for example, ±0.4 mm and the width within an interval of up to, for example, ±0.3 mm.

The spring means 17 may be designed and located in other ways than described above. Each spring means 17 can, for example, alternatively consist of a helical spring or an elastic pad of rubber or similar and it can be mounted in other ways than at a tightening ruler without loosing its function.

We claim:

1. Device for retaining knife blades for cutting or perforating a running web, the web running between a rotatable knife-retaining cylinder having a slot therein for retaining a knife blade, and a counter-pressure cylinder, said knife blade retaining device comprising:

(a) a wedge device including:

(1) at least two rulers with wedge surfaces inclined toward a bottom of the slot, including a retaining ruler positioned adjacent to a first side wall of the slot, said retaining ruler having a support portion for retaining a knife blade, and a tightening ruler, (2) at least one first spring means mounted between the rulers to move the rulers apart in a direction parallel to the blade height;

(b) a height-adjustment device connected to the wedge device to position the wedge device at a height to wedge-up the knife blade resting on the support portion upon contact between the knife blade and the counter-pressure cylinder; and (c) at least one second spring means disposed on the tightening ruler to engage a second side wall of the slot when inserted therein, said second spring means occupying a remaining width of the slot when the wedge device and knife blade are inserted therein, the second spring means being compressible for permitting insertion of a knife blade having a dimension differing from a pre-defined blade height dimension which lies within a pre-defined range of tolerance, the second spring means having a spring force for retaining the knife blade in the slot without preventing wedging up of the knife blade upon contact with the counter-pressure cylinder.

2. Device according to claim 1, wherein a side of the tightening ruler adjacent to the second side wall of the slot is provided with at least one recess for the second spring means, and the second spring means protrudes out of the recess for engaging the second wall.

3. Device according to claim 2, wherein a portion of the second spring means situated outside the recess has a width of 0.3–1.0 mm.

4. Device according to claim 3, wherein the width of the portion of the second spring means is about 0.5 mm.

5. Device according to claim 1, wherein the second spring means has a height which exceeds half the height of the tightening ruler.

6. Device according to claim 5, wherein a plurality of second spring means are disposed on the tightening ruler.

7. Device according to claim 6, wherein the height adjustment device includes height-adjustment screws, and the second spring means are disposed therebetween.

8. Device according to claim 1, wherein the second spring means includes resilient material in the form of polyurethane.

9. Device according to claim 8, wherein the second spring means includes an elastic strip of polyurethane attached to the tightening ruler.

10. Device according to claim 1, wherein the second spring means is compressible 0.1–1.0 mm from an original shape and has a spring tension during compression sufficient to retain the knife blade at a height which varies within an interval of about ±0.2 mm.

11. Device according to claim 10, wherein the spring tension is sufficient to retain the knife blade at a width which varies within an interval of about ±0.1 mm.

12. Device according to claim 10, wherein the second spring means is compressible 0.1–0.5 mm.

13. Device according to claim 1, wherein the second spring means is compressible 0.1–1.0 mm from an original shape, and has a spring tension, during compression, sufficient to retain the knife blade at a width which varies within an interval of about ±0.1 mm.

14. Device according to claim 1, wherein the support portion displaces the retaining ruler during an adjustment maneuver.

15. Device according to claim 11, the second spring means further being compressible for permitting insertion of a knife blade when the knife blade has a second dimension differing from a pre-defined blade width dimension which lies within a second pre-defined range of tolerance.

* * * * *